US006969120B2

(12) United States Patent
Levin

(10) Patent No.: US 6,969,120 B2
(45) Date of Patent: Nov. 29, 2005

(54) FOLDABLE BABY'S CHAIR

(76) Inventor: Collin Ilan Levin, 32 Murray Street, Waverley, Johannesburg, 2132 Gauteng Province (ZA)

( * ) Notice: Subject to any disclaimer, the term of this patent is extended or adjusted under 35 U.S.C. 154(b) by 0 days.

(21) Appl. No.: 10/489,582

(22) PCT Filed: Aug. 28, 2002

(86) PCT No.: PCT/ZA02/00134

§ 371 (c)(1),
(2), (4) Date: Mar. 12, 2004

(87) PCT Pub. No.: WO03/017804

PCT Pub. Date: Mar. 6, 2003

(65) Prior Publication Data

US 2004/0239165 A1 Dec. 2, 2004

(30) Foreign Application Priority Data

Aug. 30, 2001 (ZA) ..... 2001/7173

(51) Int. Cl.[7] ..... A47C 7/00
(52) U.S. Cl. ..... 297/440.12; 297/250.1
(58) Field of Search ..... 297/255, 256, 297/256.17, 250.1, DIG. 6, 440.12, 153

(56) References Cited

U.S. PATENT DOCUMENTS

| | | | | |
|---|---|---|---|---|
| RE25,936 | E * | 12/1965 | Throssel | |
| 5,106,156 | A * | 4/1992 | Marquis | 297/153 |
| 5,366,271 | A * | 11/1994 | Johnston et al. | 297/250.1 |
| D383,636 | S * | 9/1997 | Harris | D6/601 |
| 6,485,100 | B1 * | 11/2002 | Hitt | 297/228.13 |
| 6,767,058 | B2 * | 7/2004 | McClellan-Derrickson | 297/255 |

* cited by examiner

*Primary Examiner*—Milton Nelson, Jr.
(74) *Attorney, Agent, or Firm*—Brooks Kushman P.C.

(57) ABSTRACT

A folding baby's chair is provided comprising a series of substantially rigid panels interconnected by hinges between adjacent panels. The series of panels includes at least a seat panel, a backrest panel and side panels. Selected panels are provided at free edges thereof with attachment flaps having releasable fasteners cooperating with releasable fasteners provided on cooperating portions of cooperant panels such that the folding seat is held in an erected condition by virtue of inter-engagement the fasteners. Preferably the fasteners are of the hook and loop type and the flaps are formed as additional panels adapted to be at least partially, and optionally fully, superimposed over another panel to which each is releasably attached in the erected condition.

14 Claims, 2 Drawing Sheets

FOLDABLE BABY'S CHAIR

FIELD OF THE INVENTION

This invention relates to a folding baby's chair and, more particularly, to a folding baby's chair that is simple and inexpensive to fabricate; easy to erect and collapse as and when required, and that can be provided with a variety of different safety and utility features.

BACKGROUND TO THE INVENTION

Numerous different forms of folding baby's chairs have been proposed and are available on the market. Most of these, as far as applicant is aware, assume the form of a folding frame having fabric panels (that are generally cushioned) filling in spaces defined by the frame. Such a construction is generally relatively complicated; consequently costly; not always simple to erect and collapse as and when required; sometimes awkwardly shaped for transport and storage purposes in the collapse condition; and often have protruding formations that can be potentially harmful if appropriate care is not exercised.

OBJECT OF THE INVENTION

It is an object of this invention, therefore, to provide a folding baby's chair that may be designed to be extremely simple and inexpensive to manufacture and that can be easily and swiftly erected and collapsed as and when required.

SUMMARY OF THE INVENTION

In accordance with this invention there is provided a folding baby's chair comprising a series of substantially rigid panels optionally covered with a suitable flexible woven or non-woven sheet material and interconnected by means of hinges between adjacent panels, the series of panels comprising at least a seat panel, a backrest panel and side panels, the folding baby's chair being characterized in that selected panels are provided at free edges thereof with attachment flaps having releasable fasteners cooperating with releasable fasteners provided on cooperating portions of cooperant panels such that the folding chair is held in an erected condition by virtue of inter-engagement of said fasteners.

Further features of the invention provide for the fasteners to be of the hook and loop type such as that sold under the trade name "VELCRO"; for the flaps to be formed as additional panels adapted to be at least partially, and optionally fully, superimposed over the panel to which each is releasably attached; for the side panels to have a rear section extending up the height of the rear panel and a forward section of considerably lower height; for each of the side panels or superimposed connecting flaps to have a part of a support panel hingedly attached to the upper edge of the forward section thereof with the two support panels being adapted to overlap in which condition fasteners conveniently of the hook and loop type releasably secure them together; and for a separate rigid table panel to be provided for releasable cooperation with the support panels.

Still further features of the invention provide for the entire series of panels to consist of inner panels sandwiched between layers of padding and two outer layers of said sheet material; for the sheet material covering the opposite sides of the panels to be secured together along lines between the panels to define said hinges; for harness straps to be provided for restraining an infant within the baby's chair; and for attachment straps to be provided for releasably securing the baby's chair to a support therefor, typically a free standing chair.

In order that the above and other features of the invention may become more apparent, one embodiment thereof will now be described with reference to the accompanying drawings.

DETAILED DESCRIPTION WITH REFERENCE TO THE DRAWINGS

Figure 1:
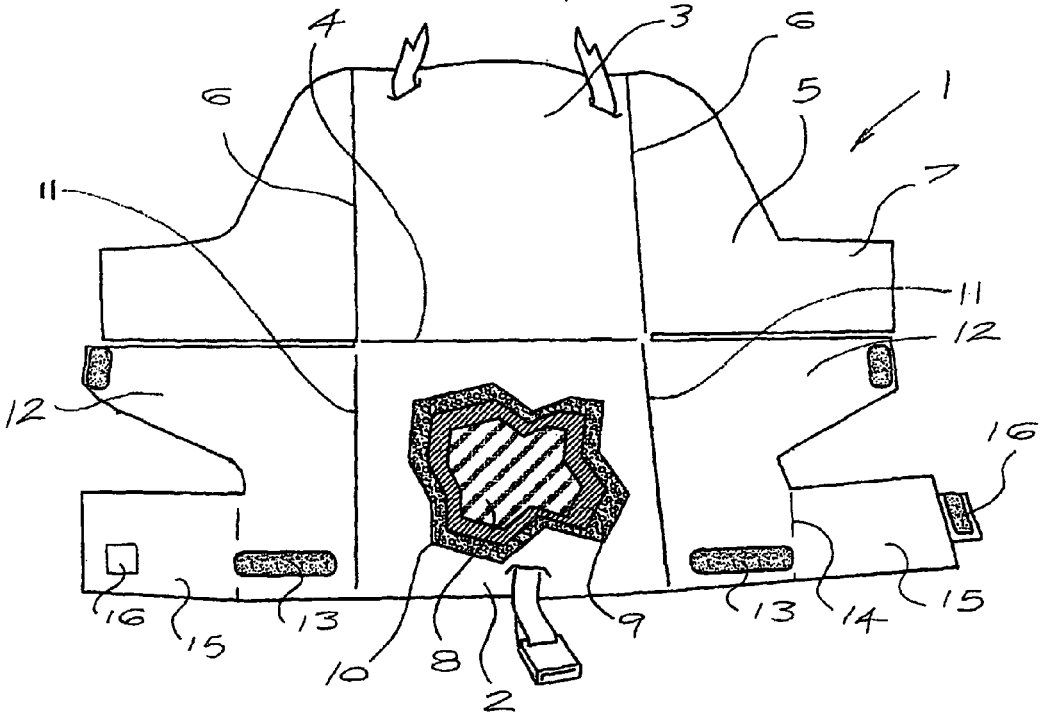
FIG. 1 is a plan view of one embodiment of baby's chair according to the invention in an opened out condition.
Figure 2:
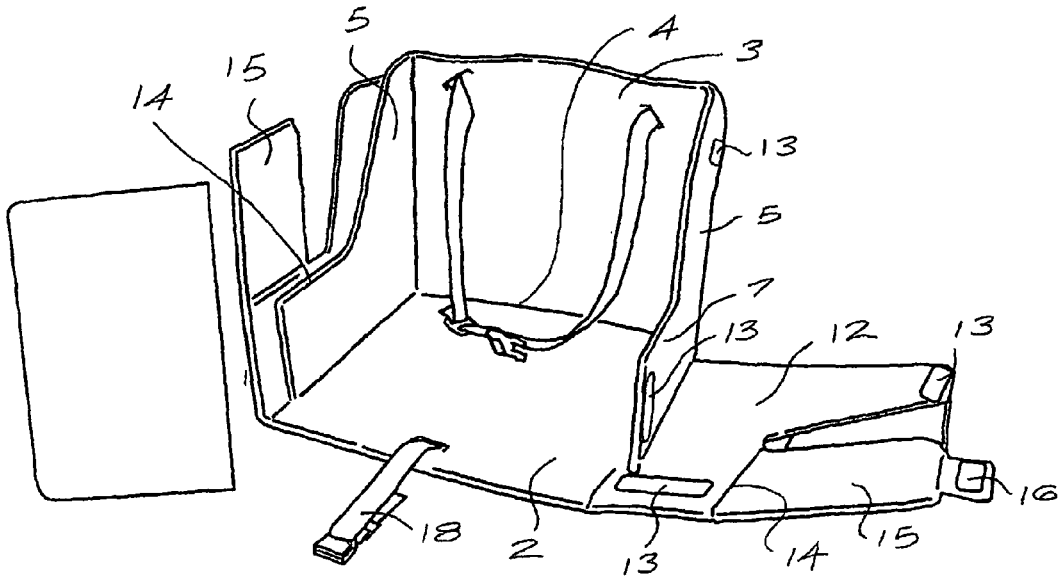
FIG. 2 is a perspective view of the baby's chair in a partly erected condition.

In this embodiment of the invention the baby's chair, generally indicated by numeral (1), is formed from a series of inner panels that are made of substantially rigid sheet material covered with a layer of padding material on both sides, and on the outside with an outer sheet of, in this case, waterproof plastics material. The inner panels can be made of any suitably strong and rigid material and may, for example, be made of a suitable thickness of composition board (commonly available under the trade name MASONITE). The sheets of plastics material can be appropriately decorated with pictures or other graphics that would be appealing to children.

As a general structural feature that will become more apparent from the following, the two outer sheets of material are secured together between the edges of adjacent inner panels to form hinges by virtue of the flexible nature of the plastic sheet material and the padding material. In many cases the two sheets of plastic are of thermoplastic material and can simply be thermally welded together with the padding material similarly becoming welded to the outer sheets along one or more lines to form hinges between the various panels.

More particularly, the baby's chair comprises a seat panel (2) to the rear edge of which is attached the operatively lower edge of a backrest panel (3) by way of a hinge formation (created as described above) indicated by numeral (4). A side panel (5) is attached to each operatively generally vertical edge of the backrest panel (3) by way of a hinge formation indicated by numeral (6). Each side panel has a rear portion extending up the full height of the backrest panel and a forward portion, indicated by numeral (7), of substantially lower height so as to correspond with the height of a table panel that will be described below.

Simply for the sake of illustration, an inner panel (8) forming the inside of the seat panel is shown in FIG. 1 as having a layer (9) of padding of thermoplastic fibrous material that is in turn covered by the outer sheet (10).

Each side of the seat panel has attached thereto by way of a hinge formation (11), a connecting flap (12) that in this case is substantially a duplicate of the side panel (5) and is adapted to be superimposed over the side panel in the erected condition. The side panels (5) and connecting flaps (12) are provided with co-operating pads (13) of hook and loop fastener material so that they can be releasably fastened together in this superimposed relationship. Conveniently, a pad of fastener material is provided towards the operatively upper end of each side wall and towards the front of each side wall.

Each of the connecting flaps has hingedly attached thereto, in the same manner, by way of a hinge formation (14), a support panel (15) wherein the two support panels are adapted to overlap in the operative position and be secured in this position also by means of a hook and loop fastener arrangement indicated by numeral (16). The height of the support panel thus corresponds to the upper edge of the forward lower portions (7) of the side panels.

Figure 3:
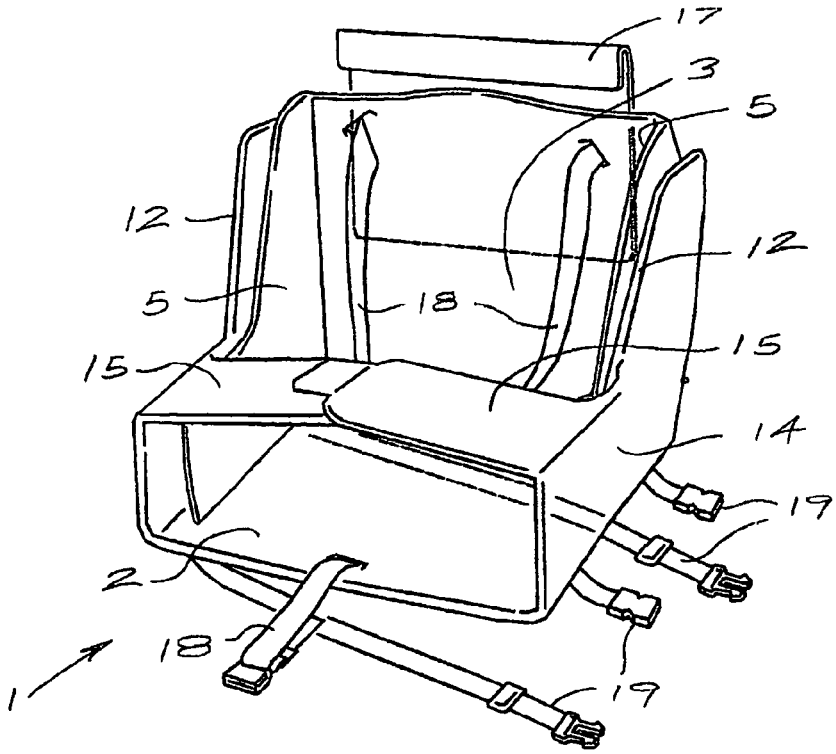
FIG. 3 is a schematic perspective view of the baby's chair in a fully erected condition with the table panel in a stored position; and, FIG. 4 is a perspective view of the baby's chair in an erected condition and showing the table panel in its operative position.
Figure 4:
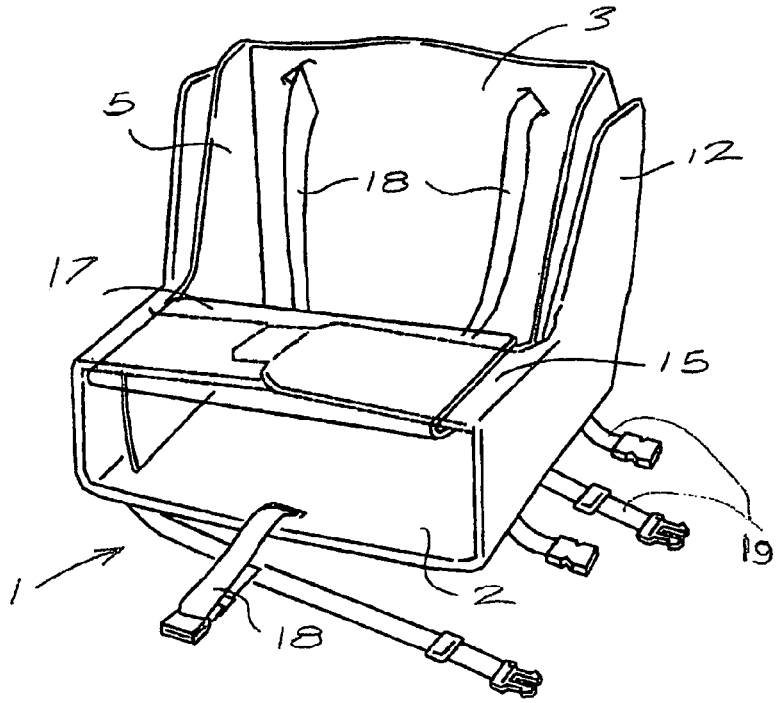

A rigid table panel (17), preferably of plastics material, is provided for removable association with the support panels, as illustrated in FIG. 4. The rigid table panel has one longitudinal edge doubled over to a U-shaped configuration so that it can be hooked over the edges of the support panels to keep it in position. A pocket could be provided at the rear of the backrest panel to accommodate the table panel when it is not in use as shown in FIG. 3.

Finally, the baby's chair is provided with a full harness strap assembly indicated by numeral (18) for restraining an infant within the erected baby's chair. Also, the underneath of the seat panel is provided with a pair of attachment straps (19) whereby the seat panel can be temporarily strapped to a support for the baby's chair such as a conventional free standing chair (not shown). Still further, in order to locate the baby's chair on a smooth surface such as that of a table top, the underside of the seat panel can also be provided with suction cups (not shown).

It will be understood that the baby's chair described above will be extremely simple to erect as and when required. All that is required is a simple folding operation of the assembly about the hinge formations and engagement of the co-operating fasteners which, in the case of hook and loop fasteners, simply requires that they be urged into engagement with each other. Similarly, collapsing only requires the fasteners to be disengaged and the panels to be folded as may be required.

The baby's chair has a number of additional features and uses and, in particular, in the opened out position illustrated in FIG. 1, the assembly of panels can be used as a play mat for an infant; as a surface on which to sleep; and as a comfortable surface for the purpose of changing an infant's nappy, for example.

For transport and storage purposes the panels can be folded so that they are superimposed on each other and thus form a neat square assembly that can be fitted into a flexible or rigid carry bag or other container.

Numerous variations may be made to the embodiment of the invention described above without departing from the scope hereof. In particular, it is not necessary that the connecting flaps be made to a full-size of the panel with which they are to cooperate and a narrow connecting flap, for example having hook and loop fasteners extending along the entire length thereof, may be entirely adequate. Also, the type of sheet material used for the inner panels, outer sheets and padding may be varied widely and the baby's chair may be provided with numerous other added features. The fasteners too may be of a different type, for example suitable press studs.

What is claimed is:

1. A collapsible chair comprising:

a seat panel, a back panel hinged to the seat panel, at least one pair of opposed side panels hingedly connected to one of the seat panel and the back panel, the chair being capable of being erected with the seat panel and back panel at right angles to one another and with the side panels at right angles to both the seat and back panels, the chair further comprising main connectors releasably connecting the side panels relative to the other of the seat panel and back panel when the chair is erected, and at least one flap, which is narrower than the seat panel, and which is hingedly connected to at least one of the side panels and which is arranged to be located over a portion of the seat panel remote from the back panel in the erected chair, and additional connectors on the flap for affixing the flap relative to the other side panel of the erected chair.

2. A chair as claimed in claim 1, wherein the at least one flap further comprises a first and second flap each connected to opposed side panels on opposite sides of the erected chair, the first flap being connected to the side panel via the second flap.

3. A chair as claimed in claim 1, having a pair of second side panels hingedly connected to the other of the seat and back panels, wherein the main connectors including cooperating members on the first and second side panels which are adjacent to each other.

4. A chair as claimed in claim 1, where the connectors are hook and loop connectors.

5. A chair as claimed in claim 1, comprising a separate table portion, which engages the flaps when the chair is erected.

6. A chair as claimed in claim 5, wherein the table portion has a reentrant groove on its underside in which the flap is received.

7. A chair as claimed in claim 1, in which the series of seat panel, the back panel, and the side panels each consists of an inner panel member, a layer of padding on either side, and an outer layer of sheet material.

8. A chair as claimed in claim 1, in which the sheet material covering the panels is secured along lines between the panels to define said hinges.

9. A chair as claimed in claim 1, in having harness straps secured respectively to the seat and back panels, the straps releasably engaging one another for restraining an infant within the chair.

10. A chair as claimed in claim 1, having an attachment means secured to at least one panel, the attachment means enabled to releasably secure the chair to an appropriate support structure.

11. A collapsible chair comprising:

a rectangular seat panel having a pair of side edges and a pair of end edges, a rectangular back rest panel having a pair of side edges and a pair of end edges, one of the end edges of which is hingedly connected to an end edge of the seat panel, a pair of generally "L"shaped first side panels each having a base hingedly connected to the side edges of the back rest panel and a leg extending from the back rest panel at its part closest to the seat panel, the leg projecting away from the side edges of the back rest panel, a pair of second side panels hingedly connected to the side edges of the seat panel each said second side panel having:

a web part hinged to the seat panel and being as deep as the said leg and an inner arm located close to the first side panel closest thereto, and a pair of flaps which are less wide than the seat panel and which are respectively hinged to either of the first and second side panels, the chair being capable of being erected with the seat panel and the back rest panel approximately at right angles to one another, with the first side panels parallel and approximately at right angles to the back rest panel and overlying the seat panel, and the second side panels lying approximately at right angles to the seat panel and side by side with the first side panels and the flaps lying over the other of the side panels parallel to the seat part;

the chair further comprising connector means operative in the erected chair, the connector means comprising:

first connectors connecting arms of the second side panels to the adjacent first side panels, second connectors connecting the legs to the second side panels, and third connectors connecting ends of the flaps.

12. A collapsible chair as claimed in claim 11, wherein the flaps extend from the web part of the second side panels.

13. A chair as claimed in claim 11, further comprising a table part having a main section, a dependant outer wall and a rim extending from the lower end of the wall below the main section, the rim forming with the main section a groove, wherein flaps of the chair are received within the said groove when the chair is erected.

14. A chair as claimed in claim 11, wherein the connectors comprise cooperating hook and loop connectors.

* * * * *